United States Patent [19]

Hansen et al.

[11] 3,956,165

[45] May 11, 1976

[54] BLEACHING AID

[75] Inventors: Gerald D. Hansen, Holicong; Elizabeth G. Varney, Levittown; Philip S. Davis, Furlong, all of Pa.

[73] Assignee: Betz Laboratories, Inc., Trevose, Pa.

[22] Filed: Dec. 9, 1974

[21] Appl. No.: 531,021

Related U.S. Application Data

[62] Division of Ser. No. 374,839, June 29, 1973, Pat. No. 3,878,037.

[52] U.S. Cl. ..... 252/182; 8/108 A; 8/115.6; 106/197 C; 162/73; 252/95; 252/187 H

[51] Int. Cl.[2] ..... C11D 3/395; D06L 3/08; D21C 9/14

[58] Field of Search ..... 252/187 H, 95; 8/115.6, 8/108; 106/197 C; 427/288, 339, 342, 390, 392, 396, 412; 162/73

[56] References Cited

UNITED STATES PATENTS

| | | | |
|---|---|---|---|
| 3,393,153 | 7/1968 | Zimmerer et al. | 252/187 H |
| 3,606,989 | 9/1971 | Park | 252/95 |
| 3,666,680 | 5/1972 | Briggs | 252/187 H |
| 3,748,220 | 7/1973 | Gard | 162/72 |

*Primary Examiner*—Benjamin R. Padgett
*Assistant Examiner*—Irwin Gluck
*Attorney, Agent, or Firm*—Alexander D. Ricci

[57] ABSTRACT

The present invention is directed to pulp bleaching processes, and in particular compositions for use in the bleaching process to enhance the efficiency of the process. It was discovered that if a low molecular weight water soluble polymer of acrylic acid, or water soluble salt thereof was added either alone or together with a carboxymethyl cellulose to the bleaching solution, that less bleaching solution was required.

4 Claims, No Drawings

BLEACHING AID

This is a division of application Ser. No. 374,839 filed June 29, 1973 which is now U.S. Pat. No. 3,878,037.

BACKGROUND OF THE INVENTION

The bleaching of wood pulp to obtain lighter grades of pulp to produce correspondingly lighter or whiter grades of paper finds its origin long into the past as indicated by U.S. Pat. No. 11,343 (July 18, 1854).

Since this time many advances have been made in the processes, however modern methods still utilize chlorination, caustic extraction to dissolve chlorinated lignins, and final hypochlorite bleaching in one or more stages.

The theory of reactions occurring in chlorination and hypochlorite bleaching of alkaline pulps for example is described quite comprehensively in Chapters II and IV of "The Bleaching of Pulp" Tappi Monograph Series No-10. Basically calcium and sodium hypochlorite solutions have been utilized for the bleaching of pulp which for the most part require alkaline solutions.

As is well-known, different grades of paper require different degrees of brightness of the pulp. In order to obtain the brightness level desired, the pulp has a certain demand of calcium or sodium hypochlorite (commonly referred to as "hypo") to perform the function desired to in turn produce the desired brightness level. These parameters are well defined by the mill personnel only because of comprehensive testing and experience. Accordingly for a desired brightness for a certain pulp, mill personnel can quite accurately estimate the conditions of bleaching required together with the hypo demand. The overall costs of the bleaching operation even if only the costs of the bleaching chemicals are considered, is quite substantial. Accordingly mills look favorably upon any additives or procedural innovations which can lessen these costs to any degree.

It was to this objective that the present inventors directed their attention. The present inventors felt that if the bleaching reaction could be controlled relative to the rate of reaction that perhaps greater bleaching efficiency could be obtained. It was discovered that if a low molecular weight water soluble polymer of acrylic acid (or water soluble salt) having a molecular weight of approximately 500 to 20,000 was added to the hypo solution, that the rate of reaction in fact was controlled so as to provide what was believed to be a slower bleaching cycle, or slower reaction rate thereby a smoother, more even, and accordingly a more effective bleaching operation. Because of these achievements, less hypo was required to obtain a prescribed brightness value. This represented a cost savings which obviously was quite impressive to bleaching operations' personnel. Treatments using from about 0.5 to 100, and preferably from 1.0 to 50 parts per million parts of pulp slurry were found to be quite effective. Although the polymers described have been found to be suitable for the purpose when used alone, the preferred treatment is a combination of the polymer with carboxymethyl cellulose (or water soluble salt thereof and preferably the sodium salt) in a weight ratio of from 12:1 to 1:12 polymer to methylcellulose with the preferable ratio being 10:1 to 1:6. The desired treatment range with the combination was also 0.5 to 100 ppm of pulp slurry and preferably 1.0 to 50 ppm.

SPECIFICS OF THE INVENTION

The inventors tested the concept of extending the oxidative life (bleaching life) by studying the oxidation-reduction potential of treated and untreated reaction solutions. By choosing an established reaction, the amount of time necessary to reach various stages of the "oxidation-reduction potential" of the reaction could be measured. The objective of course was to extend the life of the oxidation and to avoid the formation of non-oxidizing (non-bleaching) reaction products.

In order to develop this information the following test was conducted with the results thereof being recorded in Table 1. The product used was of the following composition in the percentage by weight composition specified.

EXAMPLE 1

14.85% — sodium polyacrylate (molecular weight 1000)
1.50% — sodium carboxymethyl cellulose
0.15% — cationic surfactant (Hyamine 3500)
83.50% — water The reduction of a solution of sodium hypochlorite by sodium thiosulfate was followed with an oxidation reduction couple using a glass electrode and a platinium electrode. In order to calculate the real oxidation-reduction potential in a system where pH could vary, the pH was measured a number of times throughout the reduction cycle.

For purposes of the laboratory investigation, 1 ml of the sodium hypo solution was added to 200 ml of deionized water and titrated with an 0.1 N thiosulfate solution.

In the treated systems, 1.0 ml of the sodium hypo solution was added to 190 ml of deionized water. 10 ml of an 0.1 M solution of calcium nitrate solution together with 1 ml of product of Example 1—$10^4$ ppm was also added.

The plots of ORP vs time for the addition of 2 ml of the thiosulfate solution were made. The important aspects of such are tabulated in the following Table 1.

Table 1

| Treatment | Time to reach 75% of initial ORP | 50% |
|---|---|---|
| None | 30 seconds | 7 minutes |
| Product of Example 1 | 14 minutes | 25 minutes |

CONCLUSIONS

The length of time to reach the limiting ORP was greatly increased in the treated samples, and the rate of initial reduction was slower in the treated samples.

The effect of this activity on the bleaching of pulp is thought to be two fold:

1. a slower rate prevents uneven attach on the residual lignin and results in a lower bleach consumption to attain a desired brightness, and
2. the lower rate of reduction limits the formation of chlorate ion in the bleach liquor, which is a non-bleaching ion in this environment.

MILL-TRIALS

In order to establish the in-field efficacy of the product, a plant trial was conducted using the Product of Example 1. The mill which was located in the State of Washington, was bleaching a fir pulp. The desired brightness according to the mills' scale was 84GE. The Product was added directly to the calcium hypochlorite bleach solution in an amount 18 parts per million parts of pulp slurry. The Product's efficacy was compared to the efficacy of the commercial product currently being used by the mill. The comparative results are set forth in the following Table.

Table 2

| Treatment | Objective: 84GE Fir Days of Treatment | lbs/ton of hypo required to produce objective |
|---|---|---|
| Commercial Product | (over period used) | 34.0 |
| Product of Example 1 | 1–6 | 29.9 |
| Product of Example 1 (Dosage increased to 20ppm) | 7–14 | 28.5 |
| Commercial Product Later date | 15–22 | 34.1 |
| Commercial Product | 1–24 | 31.4 |
| Product of Example 1 | 25–48 | 28.7 |
| Average hypo requirement: Commercial Product = 33.2 lb/ton Product of Example 1 = 29.0 lb/ton | | |

Reduction in hypo demand with the use of Product of Example 1 = 12.65%
Therefore 4.2 lb/ton reduction = 14 gallons per ton realized or 42 cents/ton saving.

A second trial was conducted at a mill located in Wisconsin. This mill also used calcium hypochlorite as the bleaching agent and averaged 170 tons/day of pulp bleached.

The mill utilized a "hypo factor" procedure in determining the amount of bleaching necessary to obtain a given brightness of pulp. The mill's criteria was as follows:

0.1 hypo factor = 1 gal/ton

Normal factor = 2.1 to obtain a given brightness

With the addition of ½ lb/ton of the Product of Example 1 to the hypo solution, the hypo factor was 1.7 which represented a substantial decrease in hypo demand.

Likewise when ¼ lb/ton of the Product of Example 1 was added to the hypo, the hypo factor was 1.8.

When the feed of the Product of Example 1 was discontinued, the hypo factor rose to 2.0 and subsequently increased to 2.1 to obtain the necessary brightness.

The mill trials substantially confirmed the conclusions derived from the laboratory studies, and clearly substantiated the effectiveness of the product.

Having thus described the invention what is claimed is:

1. A bleaching aid which comprises on a weight ratio basis from about 1:12 to 12:1 of a water soluble acrylic acid polymer or water soluble salt thereof, said polymer having a molecular weight of from about 500 to 20,000, and a water soluble carboxy methyl cellulose.

2. An aid according to claim 1 wherein the polymer is a sodium polyacrylate having a molecular weight of approximately 500 to 20,000.

3. An aid according to claim 2 wherein the polymer to carboxymethyl cellulose weight ratio is about 10 to 1.

4. An aid according to claim 3 wherein the acrylic acid polymer is sodium polyacrylate having a molecular weight of about 1000, and the carboxy methyl cellulose is sodium carboxy methyl cellulose.

* * * * *